US007810684B2

(12) United States Patent
May

(10) Patent No.: US 7,810,684 B2
(45) Date of Patent: Oct. 12, 2010

(54) PERCUSSION INSTRUMENT CARRIER WITH EXPANDABLE SHOULDER SUPPORTS

(76) Inventor: Randall L May, 2 Trafalgar, Newport Beach, CA (US) 92660

( * ) Notice: Subject to any disclaimer, the term of this patent is extended or adjusted under 35 U.S.C. 154(b) by 694 days.

(21) Appl. No.: 11/065,214

(22) Filed: Feb. 24, 2005

(65) Prior Publication Data

US 2006/0186151 A1 Aug. 24, 2006

(51) Int. Cl.
*A45F 3/04* (2006.01)

(52) U.S. Cl. ..... 224/265; 224/642; 224/643

(58) Field of Classification Search ..... 224/265, 224/642, 643; 215/228, 262; 220/212, 231
See application file for complete search history.

(56) References Cited

U.S. PATENT DOCUMENTS

| | | | | | |
|---|---|---|---|---|---|
| 4,256,007 | A | | 3/1981 | Streit | |
| 4,387,839 | A | | 6/1983 | Dranchak | |
| 4,605,144 | A | | 8/1986 | LaFlame | |
| 4,862,533 | A | * | 9/1989 | Adams, III | 5/413 R |
| 4,887,318 | A | * | 12/1989 | Weinreb | 224/264 |
| 5,054,357 | A | | 10/1991 | Pyle | |
| 5,337,646 | A | | 8/1994 | Austin | |
| D354,975 | S | | 1/1995 | Penn | |
| 5,573,158 | A | * | 11/1996 | Penn | 224/265 |
| 5,949,008 | A | | 9/1999 | Augsburger | |
| 6,096,955 | A | | 8/2000 | Ter Heide | |
| 6,109,495 | A | * | 8/2000 | Hernandez | 224/644 |
| 6,223,959 | B1 | * | 5/2001 | Chen | 224/264 |
| 6,329,583 | B1 | * | 12/2001 | May | 84/421 |
| 2004/0144816 | A1 | * | 7/2004 | Ku | 224/264 |
| 2004/0236258 | A1 | * | 11/2004 | Burns et al. | 602/13 |
| 2005/0040193 | A1 | * | 2/2005 | May | 224/201 |

FOREIGN PATENT DOCUMENTS

GB 2209459 A * 5/1989

* cited by examiner

*Primary Examiner*—Nathan J Newhouse
*Assistant Examiner*—Lester L Vanterpool
(74) *Attorney, Agent, or Firm*—Kirk A. Buhler; Buhler & Associates

(57) ABSTRACT

Percussion instrument carriers where the shoulder straps include an expandable cushioning feature. The feature allows the shoulder straps to be adjusted for the comfort of the user. Each shoulder strap may have one or more expandable cushions that will allow the top of the shoulder strap to be expanded. Multiple expandable cushioning features can be linked to allow more than one feature to fill at the same time. Expandable cushion can allow the carrier to be adjusted foreword and aft of the user to allow positioning of the carrier on the user as well as adjusted for users of different widths. An additional expandable cushion can be located on the back member.

18 Claims, 3 Drawing Sheets

PERCUSSION INSTRUMENT CARRIER WITH EXPANDABLE SHOULDER SUPPORTS

FIELD OF THE INVENTION

This invention relates to new and useful improvements in percussion carrier apparatus having expandable and or adjustable shoulder straps and back member. More particularly, the present invention relates to the shoulder straps and back member of an instrument carrier where the shoulder straps and or back member includes a bladder or inflatable member that can be filled or emptied to custom fit the carrier a user.

BACKGROUND OF THE INVENTION

The prior art discloses examples of instrument carrier hardware where the shoulder straps can be changed adjusted or replaced. These carriers require adjustment or changes to the shoulder straps or back member to accommodate different size users. None of carriers in the prior art disclose shoulder straps or adjustments to the shoulder straps or back member that allow the fit of the shoulder straps to be adjusted using one or more expandable cushions.

La Flame U.S. Pat. No. 5,400,683 discloses a carrier for percussion instruments having an abdominal plate connected at one end of a unitary frame partly encircling the wearer at the waist and having an upstanding rear portion pivotally connected to a back pressure plate. Shoulder bars are connected to the back-pressure plate and wrap about shoulders and support straps connect to the abdominal plate that has suitable fixtures for attachment of various percussion instruments. While this patent discloses a carrier for percussion instruments, it does not disclose that the shoulder bars or back member have an inflatable cushioning member.

Hsieh U.S. Pat. No. 4,799,610 shows a carrier for percussion instruments having a "T" bar, a pair of shoulder bars, a belly plate. The shoulder bars are bolted on a lateral plate of the "T" bar. The lateral plate has arc-like slots and spaced semi-circular holes permit bolts to slide in the slots. The fastening end of each shoulder bar has a hole and an arc-like slot from the upper portion to the lower portion permitting angular adjustment of the shoulder rightward or leftward for various applications. The carrier holder is applied to carrying a bass drum fastened by J-bars. While this patent also discloses a carrier for percussion instruments, it is not disclose that the shoulder bars or back-pressure plate have an inflatable cushioning member.

La Flame GB patent 2,123,676 (based on U.S. Pat. No. 4,453,442) discloses a carrier for percussion instruments or the like which includes the combination of a belly plate with a carrier bracket for supporting an instrument at an outwardly-overhung position about a fulcrum area of contact with the front waistline area of the person, a rigid band with a generally bent contour to extend along a portion of the waistline area of the person to the back of the person, a back-plate riser arm supported by the ban to extend in a generally upward direction such that a portion of the arm will extend along the back thoracic region of the person, and means carried by the arm for imparting to the thoracic back region of the person a reactive force to the overhung weight of the instrument about the aforesaid means forming a fulcrum area of contact with the person. While this patent also discloses a carrier for percussion instruments, it is not disclose that the shoulder bars or back member have an inflatable cushioning member.

Other possibly relevant prior art is Pyle U.S. Pat. No. 5,054,357; May U.S. Pat. No. 5,072,910 and May U.S. Pat. No. 5,300,810.

Various prior inventions have been disclosed that provide percussion an instrument carrier, but none of the listed inventions provide an expandable cushioning system. The ideal invention would provide one or multiple expandable cushioning pads that improve the comfort of using the carrier and allows the carrier to provide a more custom fit to the user. The proposed invention provides these features.

BRIEF SUMMARY OF THE INVENTION

One of the objects of this invention is to provide a cushioning system for an instrument carrier that allows for an expandable cushion that will pad the shoulder straps of the carrier while worn by the user.

Another object of this invention is to provide a cushioning system on the back bar or back pressure plate to improve comfort when the user wears the carrier.

Another object of this invention is to provide an inflatable system for the inflation system allows adjustment to accommodate users of different sizes.

Another object of this invention is to provide shoulder strap inflation system where multiple inflation cavities are connected and filled from the same filling location.

Another object of the invention is to provide an adjustable cushioning system that each user can set individually.

Another object of this invention is to allow the shoulder straps to be removed to allow attachment for non-cushioning shoulder straps. The removable feature allows for upgradeable or retrofitable shoulder straps.

Another object of the invention is to provide improvements in the construction of a shoulder-mounted carrier that permits almost universal adjustment of the carrier for most users.

Another object of this invention is to provide improve comfort to the user as they are wearing the carrier.

Another object of the invention is to provide expandable cushions that can push the shoulder straps of the carrier forward or aft on the user. This feature allows a single set of the shoulder straps to accommodate a wide number of different users.

Another object of the invention is to provide an adjustable cushioning system that can be quickly changed to accommodate different size users without having to remove the shoulder straps.

Various objects, features, aspects, and advantages of the present invention will become more apparent from the following detailed description of preferred embodiments of the invention, along with the accompanying drawings in which like numerals represent like components.

DETAILED DESCRIPTION OF THE INVENTION

Figure 1:
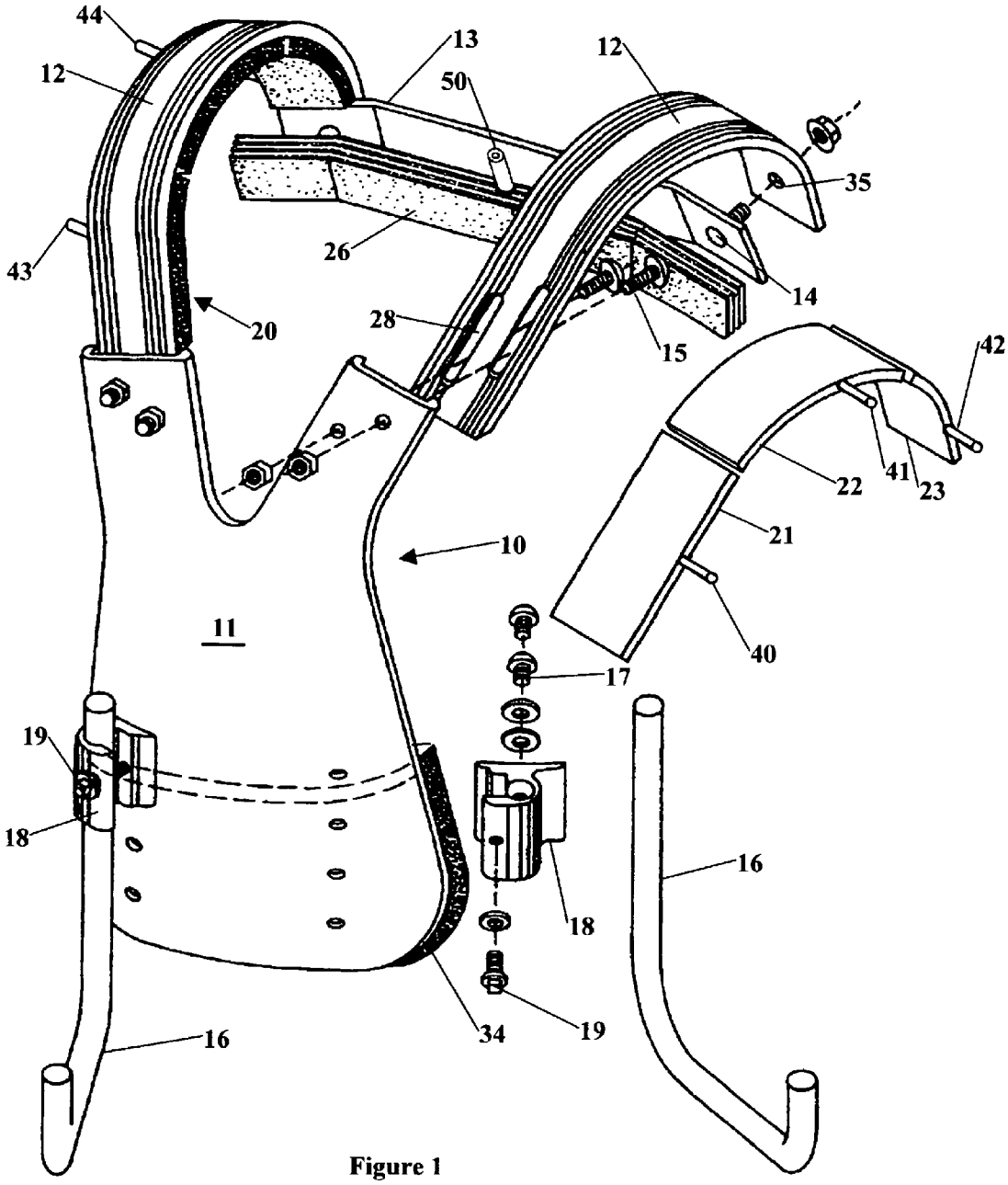
FIG. 1 is an isometric view of a carrier with multiple inflatable shoulder and back pads.

Referring to FIG. 1, there is shown a carrier 10 for percussion instruments that comprises a vest portion 11. The construction of the carrier is shown as a vest type construction, but the carrier can be any configuration including but not limited to, T-bar, tubular, vest or hybrid combination of these types of construction. Additional components consist of shoulder straps 12 and back bar 13. Back bar 13 is removably secured to shoulder straps 12 by screws or bolts 14. Back bar 13 may be fixed as by welding or the like. Carrier portion 11 is removably secured to shoulder straps 12 by screws or bolts 15. The screws or bolts that attach to shoulder straps to the carrier may connected the shoulder straps through elongated holes 28 located in the shoulder straps or on the carrier. A pair of J-rod receptacles 18 is secured by screws or bolts 17 on the carrier. The J-rods 16 are supported in receptacles 18 and secured in position by T-bolts or set screws 19. Shoulder straps 12 have cushions or pads 20, 21, 22 and 23 cushion the load of the instruments carried by carrier 10.

The materials of construction used to make a vest type carrier 10 are very important for achieving the desired result. The vest portion 11 is preferably a strong, lightweight metal or composite material such as Fiberglas®. Back bar 13 and shoulder straps 12 are rigid and made of a light metal such as aluminum, magnesium or titanium. Some prior art vests of this type have been of a one-piece Fiberglas® construction. There were incidents of failure of the shoulder straps from repeated flexing. The metal shoulder straps do not fail in flexure and also have the advantage that they may be removed and different sizes are readily installed. The vest portion 11 can be of a single size and separate shoulder straps 12 of differing radii for small, medium, large or extra large size. The inflatable shoulder straps reduce the number of different size shoulder straps by allowing the size of the shoulder straps to be inflated to accommodate users of different sizes.

Vest 11 may have suitable padding 34 over its inner surface, as needed, to avoid discomfort from the bolts or screws 15 used to assemble the straps to the vest or bolts or screws 17 used to assemble receptacles 18 on the vest. Back bar 13 may be removed or omitted for the convenience of users who prefer an open back. The back bar is shown with an inflatable pad 26. J-rods 16 are inserted in position and secured in place by tightening setscrews 19. The short outer ends of the J-rods are inserted into the J-rod receptacles on the percussion instrument being carried, e.g., drums (single or array), cymbals, xylophone, marimba, or the like. The area where the carrier makes contact with the front of the user such as the stomach can also be padded 34. In the embodiment shown, pad 34 is not adjustable, but this pad also could be a filled bladder to improve the comfort of the user or to accommodate users of different sizes.

Figure 3:
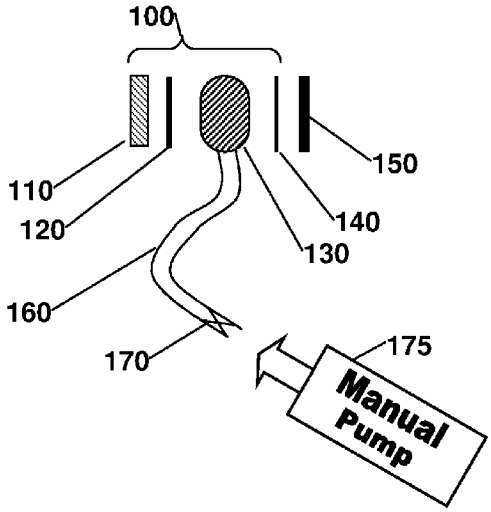
FIG. 3 is a cross-section of one contemplated embodiment of a cushion.

The cushions 20, 21, 22 and 23 that are used with the shoulder members 12 are adjustable by filling or evacuating the cushions using valves 41 through 44 on the shoulder straps and valve 50 on the back member pad 26. Refer to FIG. 3 that show a cross sectional view of the pad and expandable bladder 100 portion of the cushion on a member such as a back or shoulder 150. The expandable bladder is made from a flexible minimally stretching material such as Mylar, vinyl, PVC, Polyester, polycarbonate, polyurethane, but the bladder may be made from an expanding material such as rubber or latex.

The optional front pad 110 is a semi-firm pad made of felt, rubber, Latex, Neoprene or other similar material that allows improved comfort in addition to a surface that breaths to reduce perspiration of the user. A covering such as Mylar 120 or similar material can be located between the pad 110 and an expandable bladder 130. The Mylar sheet provides a rigid surface for the bladder to push against. This rigid surface helps to keep the bladder flatter as the bladder is filled with air to reduce ballooning of the pad. The pad 110 is can be attached directly to an expandable bladder 130 that can be filled or emptied of air. Varying amounts of air can be placed into or removed from the expandable cushion to provide varying amounts of expansion. The bladder is attached to the shoulder support/shoulder strap 12 and or the back member/back support 13 that provides additional support to the bladder cushion. The attachment of the pad to the Mylar and the Mylar to the bladder can be made using a variety of methods including, adhesive, ultrasonic, two part adhesives, Velcro or thermal bonding. The pad 130 is attached to the shoulder strap or back member using various methods including adhesive, ultrasonic, two part adhesives, Velcro or thermal bonding. In the preferred embodiment an adhesive 140 or Velcro pad(s) are used to removably attach the expandable pad to member 150.

The expandable bladder 130 is connected to a hose 160 that is used to fill and empty the expandable bladder. The hose allows for a flexible connection from the bladder(s) to the filling location. Multiple pads or bladders can be connected together with similar hoses to allow the multiple bladders to be adjusted at the same time. A spring-loaded valve 170 is located at the end of the tube to maintain pressure inside the bladder or cushion. A manual pump 175 (shown as a generic shape) can be inserted into the spring-valve and when squeezed, air is removed or vacuumed from the hose assembly, making the bladder collapse, and pull against the shoulder strap. This will be shown later in FIGS. 4 and 5. As a previously disclosed, multiple pads may be connected through the same host whereby pads expand or collapse at the same time.

In the preferred embodiment, the bladder is expanded with air, but the bladder can be filled or expanded with any gas or medium that can expand the bladder such as CO2, Argon, Helium, water, or even a powder.

Figure 2:
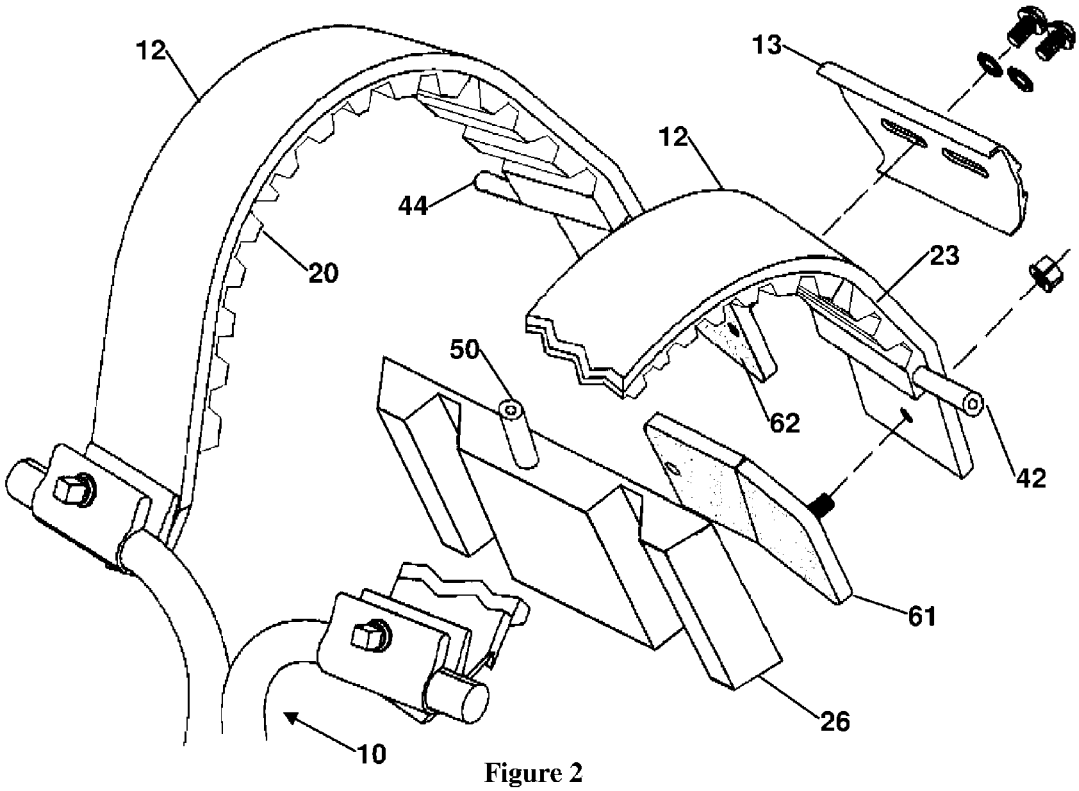
FIG. 2 is a detailed view of an inflatable back member in one possible embodiment.

Refer now to FIG. 2 that shows a detailed view of an alternative embodiment of the pads were the pads are corrugated in configuration and connected to the shoulder straps and back members. A portion of a tubular carrier 10 is shown in this figure. This corrugated configuration allows the same adjusted to fit the contour of a person but also reduces the contact area with the user. In this figure, a single valve to 42 fills the pad on one shoulder cushion and a second single to 44 fills the cushions on the other shoulder strap 12. The back pad 26 can be filled through a single valve 50. In this figure, the back member is attached to the shoulder straps using three separate pieces. Connecting members 61 and 62 are each connected to the shoulder straps while adjoining component 13 spans the connecting members 61 and 62. This three-piece configuration of the back member, allows the components of the back member to telescope or slide inside each other to allow for adjusted for the back member. While this telescoping configuration is shown with three pieces it can also be accomplished with as few as one piece with an elongated slot, two or more than three pieces that will accomplish the same result. Each corrugated padding shown here, such as 23, is filled with a separate valve, such as 42. While in this embodiment only a single fill valve is used for the entire corrugated pad, multiple valves may be used, one for each for each section of the corrugated pad.

Figure 4:
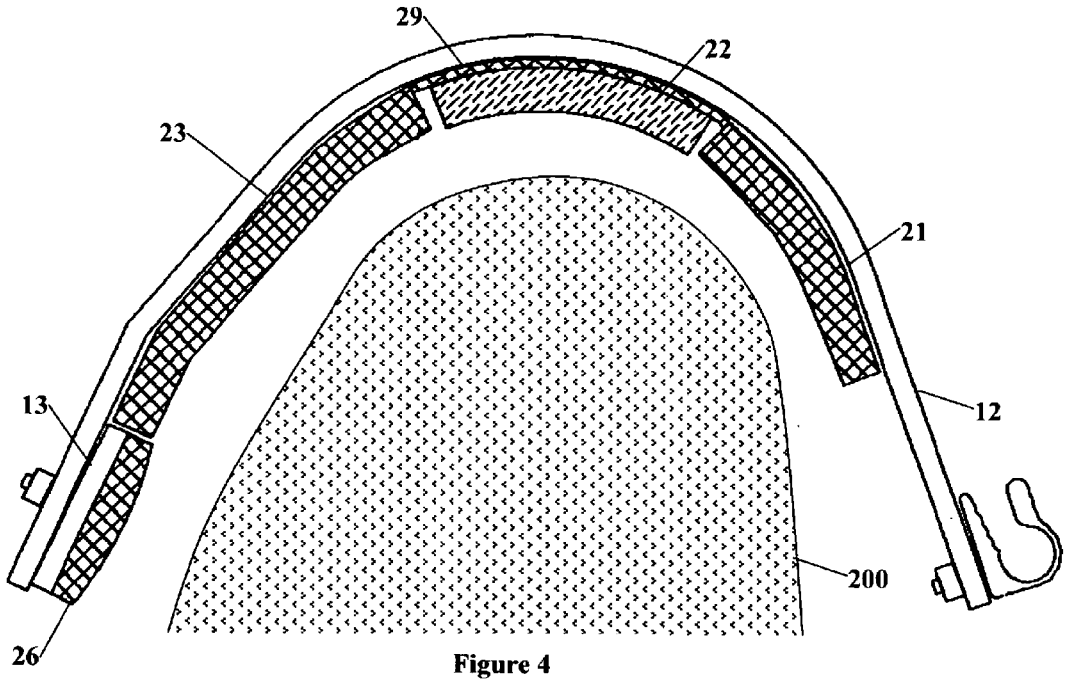
FIG. 4 is a side view of a shoulder strap area prior to inflating the pads.
Figure 5:
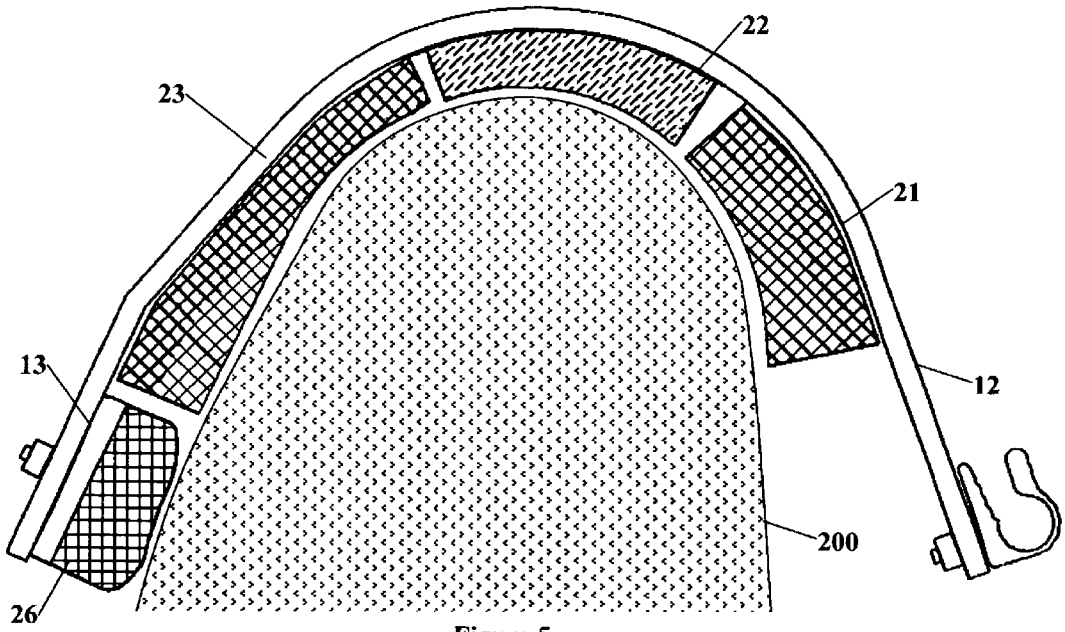
FIG. 5 is a side view of a shoulder strap area after inflating the pads shown.

Refer now to FIGS. 4 and 5 that show how the pads may expand to contour to the size and or shape of a user. In each of these figures the expandable pad 21, 22, 23 is shown attached to it a shoulder strap 12. The back member 13 is shown with expandable pad 26 attached. In FIG. 4, a connecting hose 29 connects pad 21 and 23 together so they fill at the same time. The side profile of the shoulder of a user 200 is shown in both of these figures. In FIG. 4, the pads are shown in a compressed condition. In FIG. 5 the pads are shown in an expanded condition where they adjust to the shape of the user 200. From these figures it can be seen that the expandable pads can be made to accommodate users of various sizes by simply filling or emptying the pads.

All of the embodiment of the expandable pads shown can be used with carriers that have both fixed, non-removable, shoulder straps and or removable or adjustable shoulder straps. The fixed and removable function of the shoulder straps and the expandable pads also applies to the fixed, removable and adjustable back member.

In the embodiment shown, the expandable pads can be adjusted while the carrier is installed onto a user. This allows the bladders in the invention to be adjusted without the removal of the carrier. The adjustment can also be made while a person is standing or marching, to better fit the carrier to a user while they are in motion. It is also contemplated that all the expandable cushions including the cushion on the back member be connected with a single hose. In this configuration, all of the cushions will fill with the same amount of air pressure at the same time. It is possible the connect the two front cushions with one fill line, the two back cushion with a second fill line, the two top cushions with a third fill line and the back cushion with a fourth fill line. The configuration disclosed will allow the adjustment of the carrier on the user to be moved in a parallel fashion on the user.

In another embodiment, the manual pump may be provided by an electric pump or a pressurized gas such as $CO_2$. In still another embodiment, the device can operate from a wired or wireless remote control to a mechanism mounted entirely within the shoulder strap or carrier. In still another embodiment, the invention may include a pressure gauge that shows the pressure within the air bladders, and may provide recommended pressures based upon the weight or type of instrument attached to the carrier. In still another embodiment, the invention may not use air to fill the bladders, and they may be filled with fluid, or a foam and air combination.

Thus, specific embodiments and applications for an adjustable cushions located on a carrier have been disclosed. It should be apparent, however, to those skilled in the art that many more modifications besides those described are possible without departing from the inventive concepts herein. The inventive subject matter, therefore, is not to be restricted except in the spirit of the appended claims.

What is claimed is:

1. An adjustable shoulder supported harness for percussion instruments comprising:

a shoulder supported structure for percussion instruments having at least two rigid shoulder supporting members extending behind said structure to at least one back cushioning member for securing said structure on the shoulders of a performer;

at least one inflatable cushioning and positioning member in combination with said at least two rigid shoulder members and or said at least one back cushioning member wherein said at least one inflatable cushioning and positioning member is located between said at least two rigid shoulder members and or said at least one back cushioning member and said performer where a first of said at least one inflatable cushioning and positioning member is discretely fillable relative to a second of said at least one inflatable cushioning and positioning member to move said harness on said performer to effectively alter said harness to accommodate and fit different size performers and position relative to said at least two rigid shoulder members and or-said at least one back cushioning member within said shoulder supported harness, and further includes a manual pump that is insertable into a valve to vacuum air from within said at least one inflatable cushioning and positioning member to collapse and pull said at least one inflatable cushioning and positioning member against said shoulder supporting structure.

2. The adjustable shoulder supported harness according to claim 1 wherein said inflatable cushioning and positioning member on each rigid shoulder member extends from said at least one back cushioning member to an apex of said rigid shoulder supporting member that is inflatable to position or center said performer within said shoulder supported harness.

3. The adjustable shoulder supported harness according to claim 1 wherein said inflatable cushioning and positioning member can be adjusted while located on said performer.

4. The adjustable shoulder supported harness according to claim 1 wherein multiple inflatable cushioning and positioning members can be filled from a single valve.

5. The adjustable shoulder supported harness according to claim 1 wherein if multiple inflatable cushioning and positioning member's are utilized, each member is independently adjustable to custom fit said percussion instrument carrier to said performer and move said percussion instrument carrier up, down, forward and backward on said performer position.

6. The adjustable shoulder supported harness according to claim 1 wherein filling or venting of said inflatable cushioning and positioning member allows for the position of the percussion instrument carrier on said performer to be moved forward or backward on said performer.

7. The adjustable shoulder supported harness according to claim 1 wherein said valve is a spring-loaded valve to maintain pressure and vacuum within said inflatable cushioning and positioning member(s).

8. The adjustable shoulder supported harness according to claim 1 wherein the structure is a vest, T-bar, tubular construction, or combination thereof.

9. The adjustable shoulder supported harness according to claim 1 wherein the inflatable cushioning and positioning member is located between said performer and a front rigid abdomen plate of the carrier.

10. The adjustable shoulder supported harness according to claim 1 wherein one rigid shoulder member originates in the front of the carrier, extends over a shoulder of a performer, through the at least one back cushioning member to the other rigid shoulder supporting member where it extends over the other shoulder of said performer where it terminates in front of the carrier.

11. The adjustable shoulder supported harness according to claim 1 wherein the at least one inflatable cushioning and positioning member is expandable to fill an area between said rigid shoulder supporting members and a shape of said performer.

12. The adjustable shoulder supported harness according to claim 1 wherein the at least one inflatable cushioning and positioning member is secured to said rigid shoulder member and or the at least one back cushioning member with a removable attachment mechanism that allows the position of said inflatable cushioning and positioning member to be repositioned on said rigid shoulder member and or the at least one back cushioning member to alter a direction where said shoulder supporting harness pushes upon said performer.

13. An adjustable shoulder supported harness for percussion instruments comprising:

a shoulder supported structure for percussion instruments having a front member with at least two rigid shoulder supporting members for securing said structure on the shoulders of a user and at least one rigid back member; wherein said at least one back member includes at least one inflatable positioning member located between said rigid back member wherein, said at least one inflatable positioning member is expandable to effectively alter and fill the spacing between said front member and said rigid back member to reduce movement of said harness with said two rigid shoulder supporting members on a performer using said harness, and further includes a manual pump that is insertable into a valve to vacuum air from within said at least one inflatable positioning member to collapse and pull said at least one inflatable positioning member against said shoulder supporting structure.

14. The adjustable shoulder supported harness according to claim 13 wherein said at least one inflatable positioning member is filled with foam that allows said inflatable positioning member to provide positioning without being pressurized.

15. The adjustable shoulder supported harness according to claim 14 wherein said filling and or evacuation device is used to vacuum said inflatable positioning member to reduce height of said foam within said inflatable positioning member by compressing said foam.

16. The adjustable shoulder supported harness according to claim 13 wherein the at least one inflatable positioning member is secured to said rigid shoulder member and or the at least one back member with a removable attachment mechanism that allows the position of said inflatable positioning member to be repositioned on said rigid shoulder member and or the at least one back member to alter a direction where said shoulder supporting harness pushes upon said performer.

17. An adjustable shoulder supported harness for percussion instruments comprising:

a shoulder supported structure for percussion instruments having at least two rigid shoulder supporting members for securing said structure on the shoulders of a performer;

at least one inflatable positioning member in combination with said rigid shoulder members wherein said at least one inflatable positioning member is located between said rigid shoulder members and said performer and is inflated to position and more rigidly clamp and secure said structure on said performer, and further includes a manual pump that is insertable into a valve to vacuum air from within said at least one inflatable positioning member to collapse and pull said at least one inflatable positioning member against said shoulder supporting structure.

18. The adjustable shoulder supported harness according to claim 17 that further includes at least one back member secured to the proximal end of at least one said at least two rigid shoulder members.

* * * * *